US005572777A

United States Patent [19]

Shelton

[11] Patent Number: 5,572,777

[45] Date of Patent: Nov. 12, 1996

[54] SHOE LACE TIGHTENING DEVICE

[76] Inventor: Billy R. Shelton, 5279 Salisbury Dr., Newark, Calif. 94560

[21] Appl. No.: 263,036

[22] Filed: Jun. 21, 1994

[51] Int. Cl.[6] ..... A43C 1/00

[52] U.S. Cl. ..... 24/712; 24/685 K; 24/71.1

[58] Field of Search ..... 36/50.1; 24/129 R, 24/712, 712.1, 713.3, 713.4, 71.1, 715 K, 685 K, 705 K, 68 J, 129 A, 129 D

[56] References Cited

U.S. PATENT DOCUMENTS

| | | | |
|---|---|---|---|
| 115,336 | 5/1871 | Markham et al. | 24/129 R |
| 3,094,755 | 6/1963 | Casanave | 24/129 R |
| 3,858,279 | 1/1975 | Brattstorm | 24/68 F |
| 3,930,288 | 1/1976 | Black et al. | 24/129 R |
| 5,117,567 | 6/1992 | Berger | 36/50 |
| 5,177,882 | 1/1993 | Berger | 36/50.1 |

FOREIGN PATENT DOCUMENTS

| | | | |
|---|---|---|---|
| 442810 | 4/1927 | Germany | 24/685 K |
| 47-13809 | 4/1972 | Japan | 24/129 R |
| 5513 | 4/1894 | Sweden | 24/129 R |
| 264894 | 2/1950 | Switzerland | 24/712.1 |
| 18681 | 8/1911 | United Kingdom | 24/129 R |

OTHER PUBLICATIONS

Shoe Buttons, No–tie Shoelace Fastener, Velcro, and Elastic Shoelaces: La Buda, Dennis R.; *The Gadget Book: Ingenious Devices for Easier Living;* pp. 34–35; 1985.

*Primary Examiner*—James R. Brittain
*Attorney, Agent, or Firm*—Carol D. Titus; James J. Leary

[57] ABSTRACT

A shoelace tightening device which is an elongated, flat rigid plastic body with passages or holes in each end running parallel to the flat plane. The first passage is located near one end. The other passage is more elongated and located near the opposite end. The device is used by loosely threading the shoelaces through the passages, tying the ends of the shoelaces in a secure knot, pulling the shoe lacer up and away from the foot, rotating the top end of the shoe lacer up and over until the shoe lacer has been rotated 180 degrees, and centering the shoe lacer over the remaining laces. This effectively tightens the laces by increasing the distance the lace must travel. This allows a user to secure or release his/her foot from the shoe without tying or untying the lace.

18 Claims, 4 Drawing Sheets

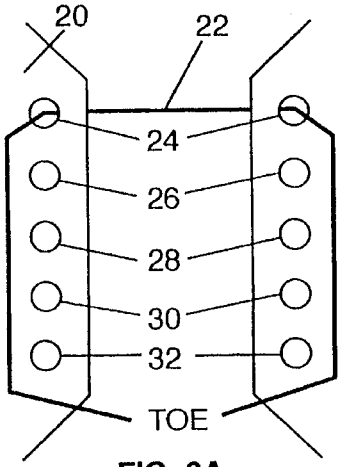
FIG. 3A
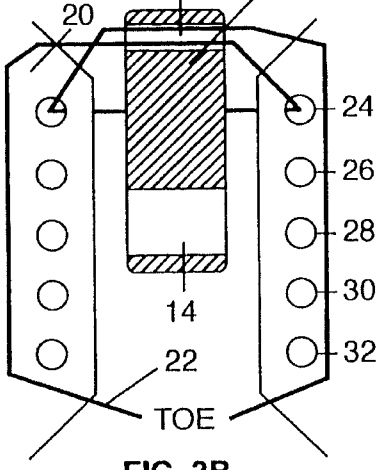
FIG. 3B
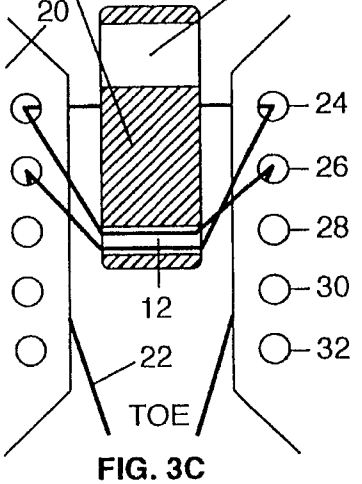
FIG. 3C
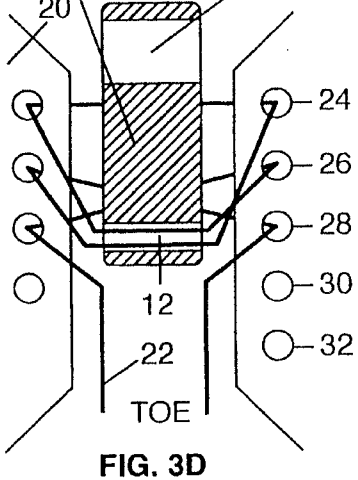
FIG. 3D
FIG. 3E
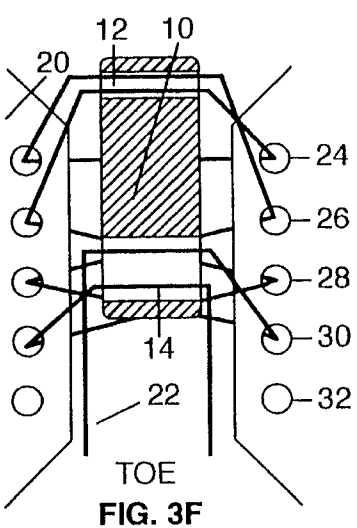
FIG. 3F
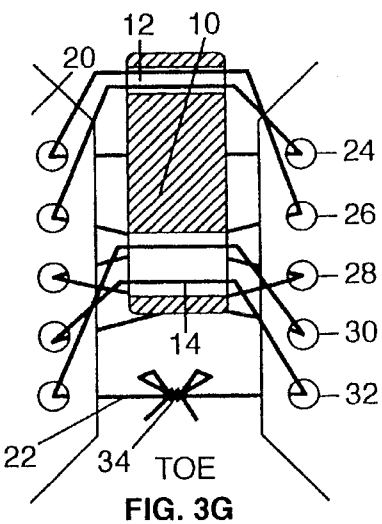
FIG. 3G

SHOE LACE TIGHTENING DEVICE

FIELD OF INVENTION

The present invention relates to a device for fastening shoes and other footwear. More particularly to a device for quickly and easily tightening and securing the laces of shoes.

BACKGROUND OF THE INVENTION

It has almost become a rite of passage in our culture for a child to learn to tie his or her own shoes. This learning process is usually slow and frustrating for both the child and the adult. Shoelace tying once again becomes a challenge as we get older and arthritis or other maladies make, manipulating the laces almost impossible, or inflexibility makes reaching or sustaining a position at our feet difficult. For many of the handicapped, it is a lifelong chore. Ultimately, there are many people who have problems tying their shoes and many hours are wasted on this task.

Over the years many people have tried to solve this enduring problem. There are sneakers with hook and loop fasteners, otherwise known as Velcro™. These sneakers have a strap with the hook fastener on one end and the loop fastener on the other end. One end of the strap is attached to one side of the shoe, run through an opening on the opposite side of the shoe, and folded back to attached onto itself. If fit properly, fasteners of this type provide a firm fit, but tend to look bulky and unkempt. Additionally, people's feet are many different shapes, and these fasteners are limited in usefulness to feet which are in the middle or average range of foot shapes. In cases where the user has a high arch, the strap may not be long enough to properly secure the shoe. If the user has an exceptionally high arch, the loop portion of the fastener will try to engage itself instead of the hook portion, thereby providing no securing at all. If the user has a low arch, the shoe would once again not be properly secured. In this case, there would also be a portion of the strap that would not engage anything and would therefore be free to flop around. In the extreme case, the hook portion of the fastener would end up trying to engage itself instead of the loop portion, providing virtually no force to secure the shoes. Hook and loop fasteners also collect a great deal of lint, etc. in the hooks and generally begin to look ragged within a relatively short period of time.

There are also shoes, especially hiking boots, with speed lacers or hooks around which the laces are placed. These allow for faster and more even lacing. The daily tying process, however, requires added steps and even more dexterity than standard laces. The hooks are also prone to catching on things as you walk or hike.

Another attempt to solve this problem is disclosed in U.S. Pat. Nos. 5,181,331; 5,177,882; and 5,117,567 to Berger. These discuss a shoe with built in channels through which a shoelace is thread. Located on the top of the instep shield is a tightening element. No discussion is made in the patents as to how this device works or how it is adjusted. For this discussion it has been assumed that there is a spool around which the lace is wound, and there is some sort of latch which locks the device from rotation after the proper tightness has been achieved. This would require the user to rotate the tightening element, then lock it in place while maintaining the current rotation. Neither this solution, nor the hook and loop fasteners, nor the speed lacers can be used with shoes that have already been purchased, new shoes must be purchased with these devices already installed.

Another attempted solution to the problem are shoelaces with a semi-rigid core. The laces are bent and tend to stay in the position they are placed in, therefore allowing the user to interlock the laces. This is certainly useful for teaching a child to tie his or her shoelaces by allowing them time to think about the next step, but this method does not work any more quickly than the standard shoelaces, in fact it would take longer. Also, although, you may not need to be as adept to tie the laces, the ultimate amount of manipulation is the same or more.

A different related problem with many solutions is the problem of shoes coming untied. There are many devices for locking the knot in place, such as clamps which are engaged after the user has tied the laces. These all still require the user to first tie the laces before the device is put into use, thereby not solving the problem which is currently at issue.

None of the prior art devices provide any systematic way to lock and unlock one's shoes. Each time the shoes are worn, care must be exercised to properly tighten the shoelaces and secure the shoe to the foot. All the prior art methods also require the user to perform significant manipulations near the foot, whether it be twisting and locking a knob or actual tying of laces.

SUMMARY OF THE INVENTION

In keeping with the foregoing discussion, the objective of the present invention is to provide a device for lacing shoes which is quick to use, easy to manipulate, and operates in a simple manner so that anyone, including children, elderly and handicapped people, would have no trouble using the device.

Another object of the invention is to allow the user to systematically, and without daily adjustment, fasten his or her shoelaces to the same tightness. The locking and unlocking evenly tightens the laces thereby providing a comfortable and secure fit without any tying or untying of the shoelaces or even daily fine tuning.

A further object of the present invention is to provide a lacing device which appears fashionable, so that it can be used on anything from sneakers to dress shoes.

Yet another object of the invention is to provide an economical lacing device by using low cost, but durable, materials and making a device which may be retrofitted to shoes which are currently in use. This allows the user to inexpensively purchase the device as well as let the user reuse the device as old shoes are discarded and new shoes are purchased.

Another object of the present invention is to provide a device which locks into place such that the shoes do not come unlaced or unlocked until the user chooses to unlock them. Also provided is a more secure or double locking method for locking a young child's shoes in place so that the child cannot remove or untie his or her shoes.

In keeping with these objectives, the present invention takes the form of an elongated, flat rigid plastic body with passages or holes in each end running parallel to the flat plane. The first passage is located near one end. The other passage is more elongated and located near the opposite end. The device is used by loosely threading the shoelaces through the passages, tying the laces in a secure knot, pulling the shoe lacer up and away from the foot, rotating the top end of the shoe lacer up and over until the shoe lacer has been rotated 180 degrees, and centering the shoe lacer over the remaining laces. This effectively tightens the laces by increasing the distance the lace must travel. This tightens and secures the laces without requiring the user to tie or untie the laces on the shoe. Other objects and advantages of the invention will no doubt occur to those skilled in the art upon reading and understanding the following detailed description along with the accompanying drawings.

BRIEF DESCRIPTION OF THE DRAWINGS

FIGS. 3A–G show the steps to install the shoe lacer.

DETAILED DESCRIPTION OF THE INVENTION

Figure 1:
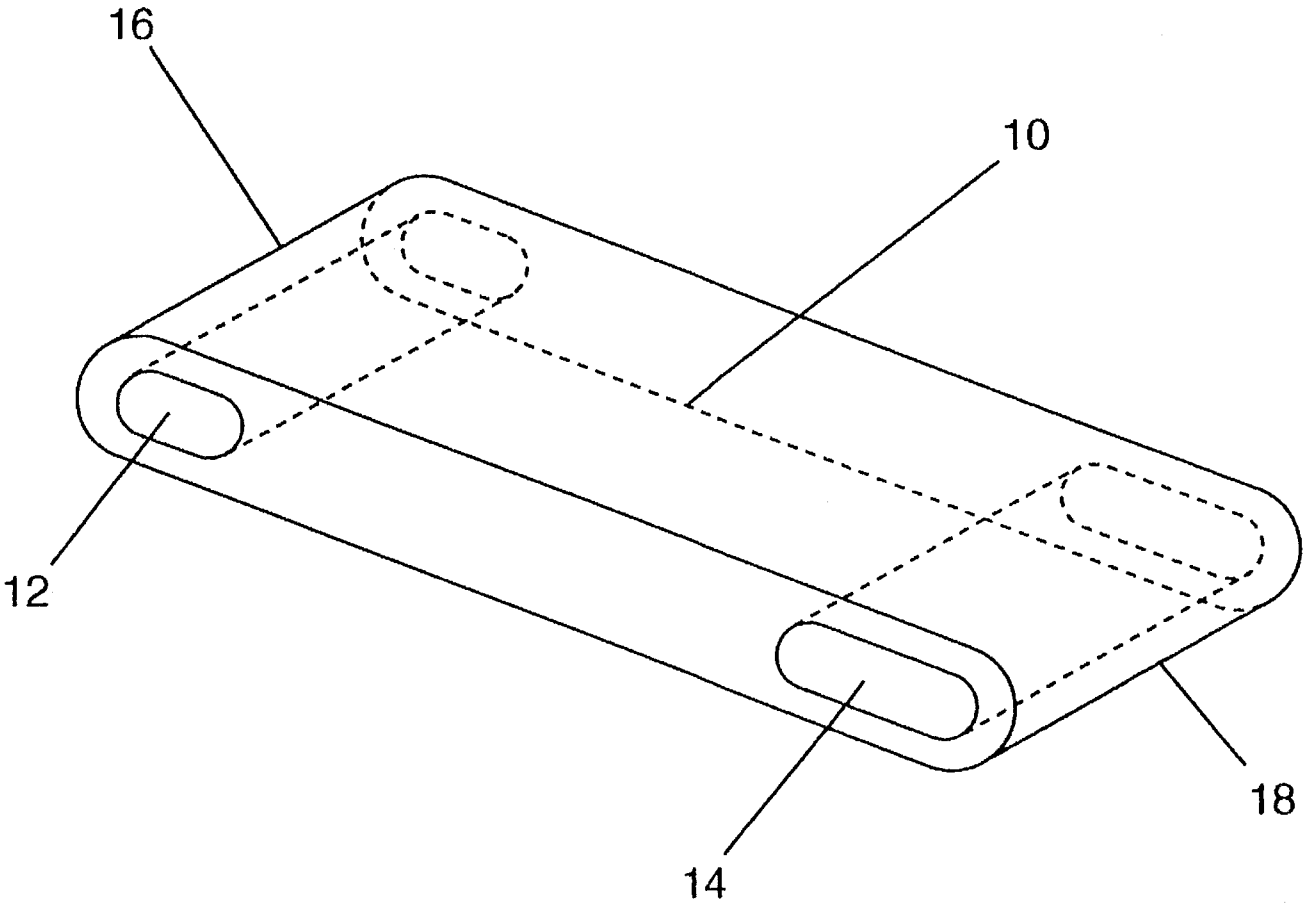
FIG. 1 shows a perspective view the shoe lacing device.

FIG. 1 shows the shoe lacer 10, which is made of virtually any relatively rigid, easily workable material, for example wood, metal, or a rigid plastic such as polypropylene, nylon, polyethylene, etc. The shoe lacer 10 is generally rectangular and has a major axis, along the long dimension, and a minor axis, along the short dimension. At one end 16 of the shoe lacer 10 there is a first passage 12, which is transverse to the major axis. In the preferred embodiment, this first passage 12 is just slightly elongated. It may also be made round, square, or virtually any other shape desired. The only requirements are that the size of the passage 12 remain approximately the same and that the shoelace may fit through the passage 12. At the opposite end 18 there is a larger elongated passage 14 which is parallel to and spaced apart from the first passage 12. This passage 14 is generally oval in shape, with the long axis of the oval parallel to the major axis of the shoe lacer 10. This elongation of the oval shaped passage 14 helps the shoe lacer 10 to function. Once again this passage 14 may change shape somewhat, as long as the basic dimensions remain approximately the same.

Both ends 16, 18 of the shoe lacer 10 are rounded to make rotating the shoe lacer 10 easy and comfortable. The rounded ends 16, 18 are also less likely to catch on pant legs, etc. The rounded ends 16, 18 are not required for the function of the shoe lacer 10 and the ends 16, 18 could be made in another shape such as triangular, oblong, oval, round or an abstract shape, even square which would be more secure, but less comfortable during the locking and unlocking process. Essentially any shape that one considered fashionable could be used. This shaping may apply to both the vertical and horizontal directions.

If desired, the shoe lacer's 10 appearance may be enhanced by the addition of decorations or team logos. These could be embossed into the shoe lacer 10, or they may be painted or dyed on. The entire shoe lacer may be dyed different colors, or dyed to specifically match a certain shoe.

Typical dimensions for a medium sized shoe lacer 10 are 2" long, ¾" wide, and ⅜" high. The shoe lacer 10 may be made in smaller sizes, 1¾" long, for children's or small shoes, or larger sizes, 2¼" long, for larger or longer shoes. In cases where the shoe lacer 10 is used for dress shoes, a narrower shoe lacer 10 may be advantageous. The wall thickness around the holes in the shoe lacer 10 varies from 1/16" to ⅛", the thicker walled shoe lacers 10 increases the durability of the shoe lacer 10. The larger elongated passage 14 is approximately ⅝" long and the smaller passage 12 approximately 5/16" long. The dimensions of these passages 12, 14 may vary somewhat depending on the length of the shoe lacer and the desire of the user.

Figure 2A:
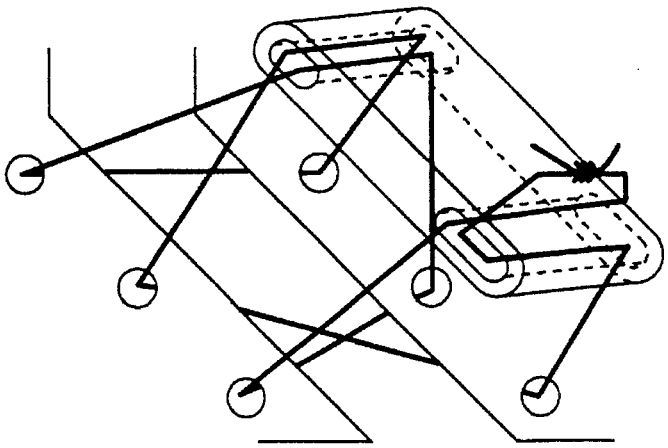
FIGS. 2A–C show close-ups of the shoe lacer installed on shoes with three, five, and seven pair of eyelets.
Figure 2B:
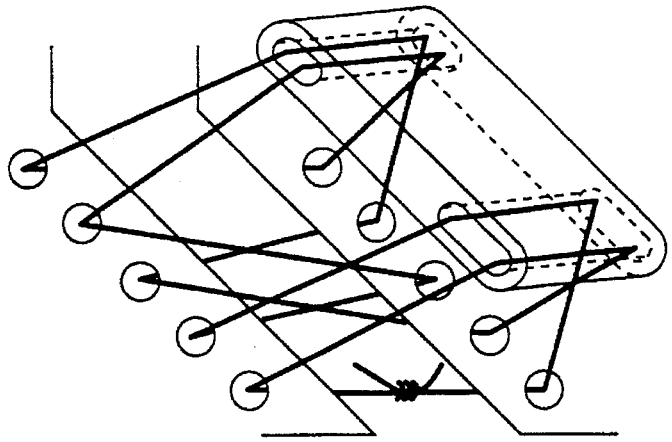
Figure 2C:
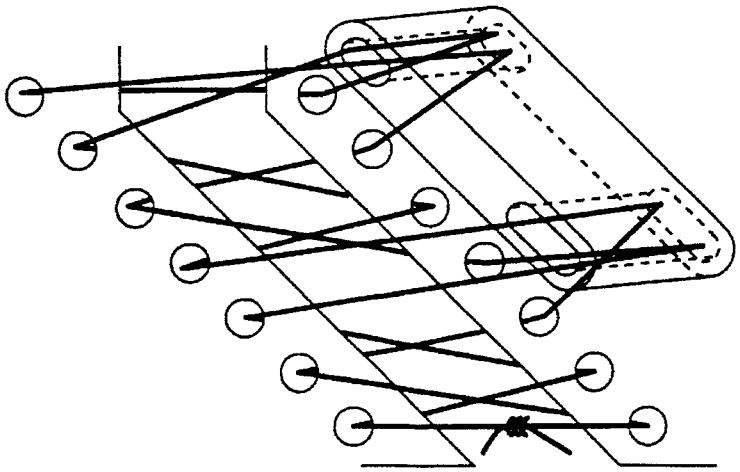

In order to function properly the shoelace 22 must thread through at least three pair of eyelets. FIG. 2A shows the shoelace 22 pattern for installation on a shoe with three pairs of eyelets. FIG. 2B shows the shoe lacer 10 on a shoe with five pairs of eyelets. Here, the added eyelets are laced in the normal manner, however, the user could skip the added eyelets and merely use one of the middle sets of eyelets for threading. With a shoe with seven pairs of eyelets the user could use all the eyelets by lacing the shoe as in the same configuration as the five eyelet shoe, then lacing the bottom two eyelets normally, as shown in FIG. 2C, or the user could skip one or more pair of the middle eyelets.

OPERATIONAL DESCRIPTION—INSTALLATION

The following is an example of how the shoe lacer 10 would be installed on a shoe 20 with five pair of eyelets 24, 26, 28, 30, 32.

Step 1—FIG. 3A Thread shoelace 22 through the top eyelets 24 in the shoe 20.

Step 2—FIG. 3B Place the shoe lacer 10 over the shoe 20 with the large elongated passage 14 toward the toe of the shoe 20 and top of side of the shoe lacer 10 facing downward. (If you want to use the double locking method for young children, and the shoe lacer 10 has a distinct top and bottom, such as a team logo, you must have the top side of the shoe lacer 10 facing up at this point.) Thread the shoelace 22 ends through the small passage 12 of the shoe lacer 10.

Step 3—FIG. 3C Rotate shoe lacer 10 up and out of the way. Place the shoelace 22 through the second pair of eyelets down from top 26 on the same side the shoelace 22 comes out of the shoe lacer 10.

Step 4—FIG. 3D Cross the shoelace 22 and thread through the third pair of eyelets 28.

Step 5—FIG. 3E Cross the shoelace 22 and thread through the fourth pair of eyelets 30.

Step 6—FIG. 3F Rotate shoe lacer 10 back into place. Thread the shoelace 22 ends through large elongated passage 14 from the side nearest eyelet 30 just threaded.

Step 7—FIG. 3G From the large elongated passage 14, thread the shoelace 22 down through the fifth pair of eyelets 32 and tie the shoelace 22 in a knot 34. After adjusting the shoe 20 for a perfect fit, the shoelace 22 may be cut to length.

When the user plans to use the double lock for extra security, the shoelace 22 may be left slightly looser, if desired, to facilitate an extra turn of the shoe lacer 10.

OPERATIONAL DESCRIPTION—DAILY USE

Following is a description of how the shoe lacer 10 is operated for locking and unlocking the shoelaces.

Figure 4A:
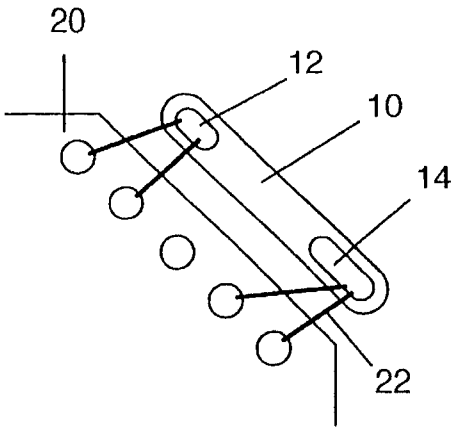
FIGS. 4A–E how the steps to lock the shoe lacer.

Step 1—FIG. 4A While the shoe lacer 10 is unlocked, the user inserts his/her foot into the shoe 20.

Figure 4B:
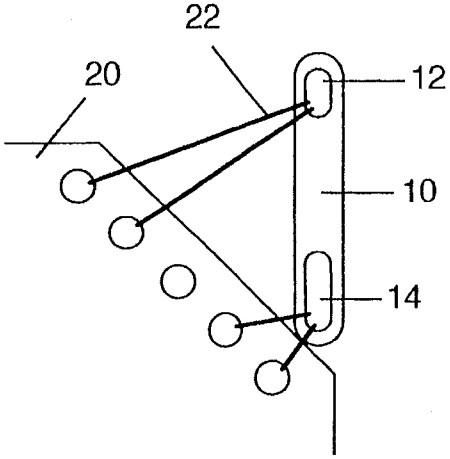

Step 2—FIG. 4B Start the lacing sequence by pulling the top end 12 of the shoe lacer 10 in an upward and outward direction. This will pull the shoelace 22 tight and make rotating the shoe lacer 10 easier.

Figure 4C:
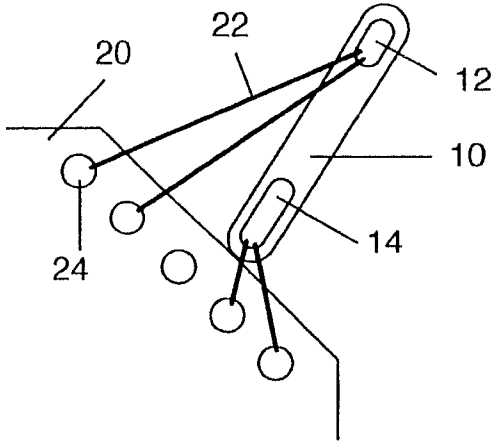

Step 3—FIG. 4C Move the bottom of the shoe lacer 10 up towards the top set of eyelets 24 as far as possible and rest it against the shoe 20. Then, rotate the top of the shoe lacer 10 over and downward.

Figure 4D:
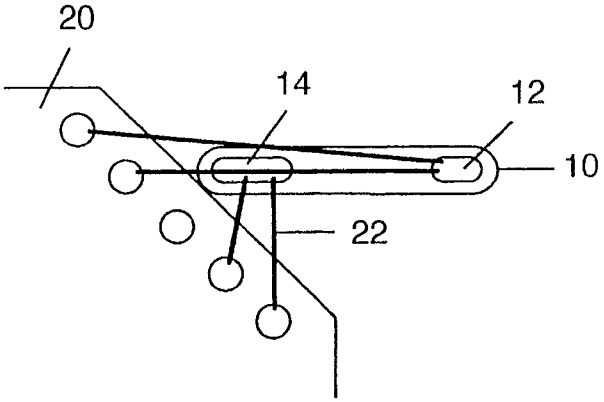

Step 4—FIG. 4D Continue the rotation until the shoe lacer 10 has been rotated 180°. You will notice that the shoelace 22 will slide forward in the large elongated passage 14. This locks the shoe lacer 10 into place. For young children you may rotate the shoe lacer 10 another 180° and slide the shoe lacer 10 upward to completely lock the shoe lacer 10 into place.

Figure 4E:
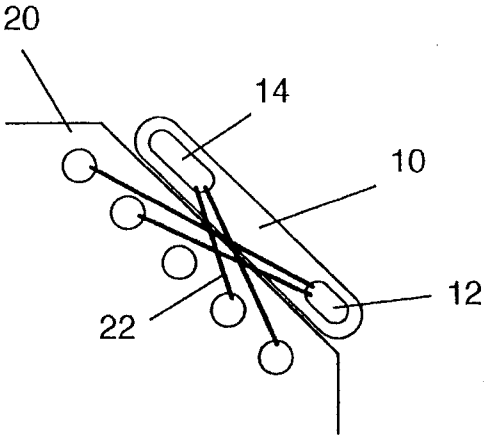

Step 5—FIG. 4E Center the shoe lacer 10 on the shoe 20.

Step 6—When the user wishes to remove the shoe he/she unlocks the shoe lacer 10 by reversing the rotation and removing his/her foot from the shoe 20.

Although the examples given include many specificities, they are intended as illustrative of only one possible embodiment of the invention. Other embodiments and modifications will, no doubt, occur to those skilled in the art. For example, the knot would not necessarily need to be tied at the bottom of the shoe. If the user preferred, the knot could be tied at the top of the shoe for a more standard look. The body of the shoe lacer could be shaped into other geometric shapes or into figures to resemble cartoon characters, animals, etc., or designs could be etched or embossed on the shoe lacer. Thus, the examples given should only be interpreted as illustrations of some of the preferred embodiments of the invention, and the full scope of the invention should be determined by the appended claims and their legal equivalents.

I claim:

1. In combination:

a shoe having a shoelace and two approximately parallel rows of eyelets, and a shoelace tightening device comprising:

a shoe lacer body having a major axis and a minor axis, a first passage through said shoe lacer body, said first passage being oriented transversely to said major axis of said shoe lacer body, said first passage being of sufficient size to allow said shoelace to be threaded through said first passage, a second passage through said shoe lacer body, said second passage being spaced apart from and approximately parallel to said first passage, said second passage being of sufficient size to allow said shoelace to be threaded through said second passage wherein said shoe lacer body has a first position and a second position:

wherein in said first position said shoe lacer body is oriented with said major axis approximately parallel to and between said two approximately parallel rows of eyelets, said first passage through said shoe lacer body is positioned proximate the top of said shoe, and said shoelace is threaded through a first eyelet proximate the top of said shoe, through said first passage to a second eyelet proximate the top of said shoe, and said second passage through said shoe lacer body is positioned proximate the toe of said shoe, and said shoelace is threaded through a third eyelet proximate the toe of said shoe, through said second passage to a fourth eyelet proximate the toe of said shoe, said shoelace being relatively slack when said shoe lacer body is in said first position, and wherein in said second position said shoe lacer body is oriented with said major axis approximately parallel to and between said two approximately parallel rows of eyelets, said first passage through said shoe lacer body is positioned proximate the toe of said shoe, and said shoelace is threaded through said first eyelet proximate the top of said shoe, through said first passage proximate the toe of said shoe to said second eyelet proximate the top of said shoe, and said second passage through said shoe lacer body is positioned proximate the top of said shoe, and said shoelace is threaded through said third eyelet proximate the toe of said shoe, through said second passage proximate the top of said shoe to said fourth eyelet proximate the toe of said shoe, said shoelace being relatively taut when said shoe lacer body is in said second position.

2. The combination of claim 1 wherein said second passage has a cross sectional shape which is elongated in a direction parallel with said major axis of said shoe lacer body.

3. The combination of claim 2 wherein the elongation acts as a locking mechanism.

4. The combination of claim 1 wherein said shoe lacer body is generally rectangular in shape, said shoe lacer body having a pair of long sides which are approximately parallel with said major axis of said shoe lacer body and a pair of short sides which are approximately perpendicular to said long sides and which are approximately parallel with said minor axis of said shoe lacer body.

5. The combination of claim 1 wherein the ends of said shoelace are tied together.

6. The combination of claim 1 wherein said shoe lacer body has a width, and said shoe lacer body has a height, and wherein said width is greater than said height.

7. The combination of claim 1 wherein the ends of said shoelace are tied together.

8. A method for tightening and securing a shoe having a shoelace and two approximately parallel rows of eyelets, said method comprising the steps of:

(a) providing a shoelace tightening device comprising:

a shoe lacer body having a major axis and a minor axis, a first passage through said shoe lacer body, said first passage being oriented transversely to said major axis of said shoe lacer body, said first passage being of sufficient size to allow said shoelace to be threaded through said first passage, a second passage through said shoe lacer body, said second passage being spaced apart from and approximately parallel to said first passage, said second passage being of sufficient size to allow said shoelace to be threaded through said second passage;

(b) placing said shoe lacer body with said major axis approximately parallel to and between said two approximately parallel rows of eyelets, with said first passage through said shoe lacer body positioned proximate the top of said shoe, and with said second passage through said shoe lacer body positioned proximate the toe of said shoe;

(c) threading said shoelace through a first eyelet proximate the top of said shoe, through said first passage to a second eyelet proximate the top of said shoe, and threading said shoelace through a third eyelet proximate the toe of said shoe, through said second passage to a fourth eyelet proximate the toe of said shoe, leaving said shoelace relatively slack; and (d) rotating said shoe lacer body about said minor axis until said first passage through said shoe lacer body is positioned proximate the toe of said shoe and said second passage through said shoe lacer body is positioned proximate the top of said shoe, thereby tightening said shoe lace.

9. The method of claim 8 further comprising the step of:

(e) continuing to rotate said shoe lacer body about said minor axis until said first passage through said shoe lacer body is positioned proximate the top of said shoe and said second passage through said shoe lacer body is positioned proximate the toe of said shoe, thereby locking said shoe lace in a tightened condition.

10. The method of claim 8 further comprising the step of:

(e) sliding said shoe lacer body upwards toward the top of said shoe and centering said shoe lacer body over said shoe.

11. The method of claim 8 further comprising the step of:

(e) tying the ends of said shoelace together.

12. In combination:

an object having a lace and two approximately parallel rows of eyelets, said parallel rows having a first end and a second end, and a lace tightening device comprising:

a lacer body having a major axis and a minor axis, a first passage through said lacer body, said first passage being oriented transversely to said major axis of said lacer body, said first passage being of sufficient size to allow said lace to be threaded through said first passage, a second passage through said lacer body, said second passage being spaced apart from and approximately parallel to said first passage, said second passage being of sufficient size to allow said lace to be threaded through said second passage, and wherein said lacer body has a first position and a second position:

wherein in said first position said lacer body is oriented with said major axis approximately parallel to and between said two approximately parallel rows of eyelets, said first passage through said lacer body is positioned proximate said first end, and said lace is threaded through a first eyelet proximate said first end, through said first passage to a second eyelet proximate said first end, and said second passage through said lacer body is positioned proximate said second end, and said lace is threaded through a third eyelet proximate said second end, through said second passage to a fourth eyelet proximate said second end, said lace being relatively slack when said lacer body is in said first position, and wherein in said second position said lacer body is oriented with said major axis approximately parallel to and between said two approximately parallel rows of eyelets, said first passage through said lacer body is positioned proximate said second end, and said lace is threaded through said first eyelet proximate said first end, through said first passage proximate said second end to said second eyelet proximate said first end, and said second passage through said lacer body is positioned proximate said first end, and said lace is threaded through said third eyelet proximate said second end, through said second passage proximate said first end to said fourth eyelet proximate said second end, said lace being relatively taut when said lacer body is in said second position.

13. The combination of claim 12 wherein said second passage has a cross sectional shape which is elongated in a direction parallel with said major axis of said lacer body.

14. The combination of claim 13 wherein the elongation of said second passage acts as a locking mechanism.

15. The combination of claim 12 wherein said lacer body is generally rectangular in shape, said lacer body having a pair of long sides which are approximately parallel with said major axis of said lacer body and a pair of short sides which are approximately perpendicular to said long sides and which are approximately parallel with said minor axis of said lacer body.

16. The combination of claim 12 wherein the ends of said lace are tied together.

17. The combination of claim 12 wherein said minor axis of said lacer body has a width, and said lacer body has a height, and wherein said width is greater than said height.

18. In a shoe of the type having two parallel rows of eyelets and a shoelace, an improvement comprising:

a shoelace tightening device comprising:

a shoe lacer body having a major axis and a minor axis, said shoe lacer body having a width along said minor axis, and said shoe lacer body having a height, and wherein said width is greater than said height, a first passage through said shoe lacer body, said first passage being oriented transversely to said major axis and parallel to said minor axis of said shoe lacer body, said first passage being of sufficient size to allow said shoelace be threaded through said first passage, and a second passage through said shoe lacer body, said second passage being spaced apart from and approximately parallel to said first passage, said second passage being of sufficient size to allow said shoelace to be threaded through said second passage, and wherein said shoe lacer body is located completely between said two parallel rows of eyelets and said major axis lies approximately parallel to said two parallel rows of eyelets.

* * * * *